US010060070B2

(12) United States Patent
Jo et al.

(10) Patent No.: US 10,060,070 B2
(45) Date of Patent: Aug. 28, 2018

(54) WASHING MACHINE

(71) Applicant: LG ELECTRONICS INC., Seoul (KR)

(72) Inventors: Mingyu Jo, Seoul (KR); Seungchul Park, Seoul (KR); Dongwon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 159 days.

(21) Appl. No.: 15/147,190

(22) Filed: May 5, 2016

(65) Prior Publication Data

US 2016/0326686 A1 Nov. 10, 2016

(30) Foreign Application Priority Data

May 8, 2015 (KR) ..... 10-2015-0064508

(51) Int. Cl.
*D06F 39/14* (2006.01)
*D06F 39/12* (2006.01)
*D06F 37/28* (2006.01)

(52) U.S. Cl.
CPC ..... *D06F 39/14* (2013.01); *D06F 37/28* (2013.01); *D06F 39/12* (2013.01)

(58) Field of Classification Search
CPC ..... D60F 37/28; D06F 39/14; D06F 37/28
See application file for complete search history.

(56) References Cited

U.S. PATENT DOCUMENTS

| | | | | | |
|---|---|---|---|---|---|
| 2,412,270 | A * | 12/1946 | Johnston | D06F 39/14 | 177/144 |
| 5,881,579 | A * | 3/1999 | Ellingson | D06F 23/06 | 68/139 |
| 6,539,753 | B1 * | 4/2003 | Ito | D06F 23/06 | 68/140 |
| 2006/0000244 | A1 * | 1/2006 | Kim | D06F 37/20 | 68/23.1 |
| 2011/0120195 | A1 * | 5/2011 | Jeoung | D06F 37/28 | 68/139 |
| 2016/0273149 | A1 * | 9/2016 | Jo | D06F 37/28 | |

FOREIGN PATENT DOCUMENTS

| | | | | |
|---|---|---|---|---|
| GB | 2360297 | A * | 9/2001 | D06F 39/14 |
| JP | 2006-280401 | | 10/2006 | |
| JP | 2006280401 | A * | 10/2006 | |
| JP | 2007111108 | A * | 5/2007 | |
| KR | 10-0240119 | | 1/2000 | |
| KR | 10-0751779 | | 8/2007 | |
| KR | 10-2010-0070707 | | 6/2010 | |
| KR | 10-2011-0057920 | | 6/2011 | |

* cited by examiner

*Primary Examiner* — Joseph L. Perrin
(74) *Attorney, Agent, or Firm* — Fish & Richardson P.C.

(57) ABSTRACT

A washing machine includes a cabinet that defines a first introduction port. The washing machine further includes a tub that is located in the cabinet and that defines a second introduction port that is concentrically positioned relative to the first introduction port. The washing machine further includes a cabinet door that is connected to the cabinet, that is configured to open and close the first introduction port, and that includes a rotating shaft. The washing machine further includes a tub door that is connected to the tub, that is configured to open and close the second introduction port, and that includes at least one rotating shaft that is spaced apart from the rotating shaft of the cabinet door.

18 Claims, 18 Drawing Sheets

WASHING MACHINE

CROSS REFERENCE TO RELATED APPLICATION

This application claims the benefit of Korean Patent Application No. 10-2015-0064508, filed on May 8, 2015, which is hereby incorporated by reference as if fully set forth herein.

FIELD

This application relates to a washing machine.

BACKGROUND

Generally, a washing machine refers to an electrical household product constructed to remove various contaminants from clothes, bedclothes and the like by employing the emulsification of detergent, rubbing action and impact action, which are applied to laundry by water streams generated by the rotation of a pulsator or a drum, and the like. Fully-automatic washing machines, which have recently been proposed, are constructed to automatically perform a series of courses composed of a washing course, a rinsing course, a dewatering course and the like, without the need for intervening manipulation on the part of the user.

SUMMARY

According to an innovative aspect of the subject matter described in this application, a washing machine includes a cabinet that defines a first introduction port; a tub that is located in the cabinet and that defines a second introduction port that is concentrically positioned relative to the first introduction port; a cabinet door that is connected to the cabinet, that is configured to open and close the first introduction port, and that includes a rotating shaft; and a tub door that is connected to the tub, that is configured to open and close the second introduction port, and that includes at least one rotating shaft that is spaced apart from the rotating shaft of the cabinet door.

The washing machine may include one or more of the following optional features. The cabinet door includes a first hinge unit that includes a rotating shaft, and the tub door includes a second hinge unit that includes at least one rotating shaft that is spaced apart from the rotating shaft of the first hinge unit. The rotating shaft of the first hinge is angled toward a rear of the washing machine between 1.5 and 3.5 degrees. The first hinge unit is located at a first side of the first introduction port, and the second hinge unit is located at a first side of a front surface of the tub. The first hinge unit includes an upper rotating part and a lower rotating part that are spaced apart by a predetermined distance, and the second hinge unit is located between the upper rotating part and the lower rotating part and is configured to support the tub door. The second hinge unit includes a stationary hinge link that is coupled to the tub; and a rotational hinge link that includes a first portion that is rotatably coupled to the stationary hinge link and that includes a second portion that is rotatably coupled to the tub door. The second hinge unit includes an elastic rotating shaft that is located on a rotating shaft of the stationary hinge link and a rotating shaft of the rotational hinge link and that is configured to elastically bias the rotational hinge link in a direction that the tub door opens. The stationary hinge link includes an upper link and a lower link that are spaced apart by a predetermined distance, and the rotational hinge link includes a first rotating part that is located between the upper link and the lower link and includes a second rotating part that is rotatably coupled to the tub door.

A portion of the rotational hinge link between the first rotating part and the second rotating part is curved in a direction that the tub door opens. The cabinet door is configured to open based on opening the tub door. The tub door is configured to close based on closing the cabinet door. The washing machine includes a cover member that is connected to the tub and that is configured to cover a front surface of the tub that is located between the first introduction port and the second introduction port. The cabinet includes a cabinet door lock that is configured to lock the cabinet door, and the tub includes a tub door lock that is configured to lock the tub door. The washing machine includes a lock-releasing device that is configured to unlock the tub door lock by unlocking the cabinet door lock based on the cabinet door being opened. The lock-releasing device includes a release lever that is located at a handle of the cabinet door; a release switch that is configured to detect an action of opening of the cabinet door in response to detecting an action of the release lever; and a tub door lock releaser that is configured to unlock the tub door lock in response to detecting an action of the release switch. The cover member includes a release button that is configured to release the tub door lock. The tub door lock releaser includes a tensile cable that is configured to unlock the tub door lock, and the release button is configured to apply tensile force to the tensile cable and is configured to unlock the tub door lock. The washing machine includes a plurality of weight balancers that are configured to dampen vibrations that are transmitted to the tub. The plurality of weight balancers are equally spaced around the second introduction port. The washing machine includes a cover member that is configured to conceal the plurality of weight balancers.

An object of the subject matter described in this application is to provide a washing machine, in which the structure between a tub and a cabinet is improved so as to prevent vibrations or noise, generated in the tub, from being transmitted to the cabinet through a gasket.

Another object of the subject matter described in this application is to provide a washing machine, in which the internal structure between a tub and a cabinet is improved so as to greatly increase the capacity of the tub, compared to a conventional washing machine.

DETAILED DESCRIPTION

Figure 1:
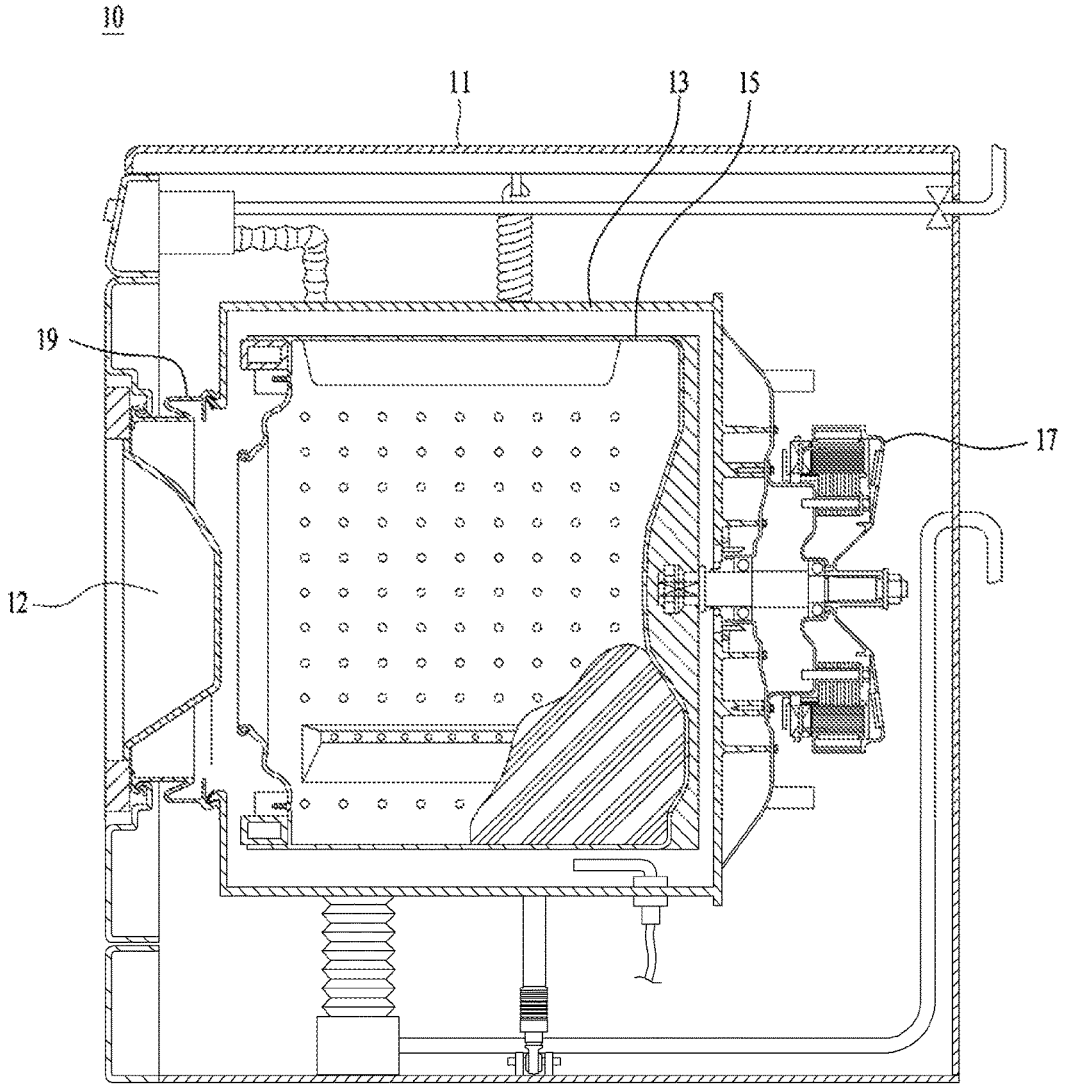
FIG. 1 is a schematic view of an example washing machine.

FIG. 1 illustrates an example washing machine 10. As shown in FIG. 1, the washing machine 10 includes a cabinet 11, defining the appearance of the washing machine 10, a tub 13, which is supported inside the cabinet 11 by means of a damper and a spring and which contains washing water, and a cylindrical drum 15, which is disposed inside the tub 13 to contain laundry and which receives driving force from the drive unit 17 for washing the laundry contained in the drum 15. This washing machine 10 may include a gasket 19 between the opening of the tub 13 and the cabinet 11 so as to prevent washing water contained in the tub 13 from leaking.

When the drum 15 rotates to wash and dehydrate the laundry contained therein, this conventional washing machine 10, which is constructed as described above, may vibrate because of the rotation of the drum 15, eccentric disposition of laundry or the like, and the vibrations generated by the rotation of the drum 15 are transmitted to the outside through the tub 13 and the cabinet 11. The vibrations and noise transmitted to the tub 13 are transmitted to the cabinet 11 through the gasket 19, which functions to maintain the watertight state between the cabinet 11 and the tub 13, thereby subjecting the cabinet 11 to vibrations and noise.

In the washing machine 10, the laundry may become caught between the door 12 for closing the tub 13 and the drum 15. In order to prevent laundry from being caught between the door and the drum, the door 12 is constructed such that the inner surface of the door 12 projects toward the inside of the opening in the tub 13 or the drum 15. In some implementations, the projecting structure of the door 12 occupies part of the washing volume in the drum 15, thereby possibly reducing the washing capacity of the washing machine 10.

Figure 2:
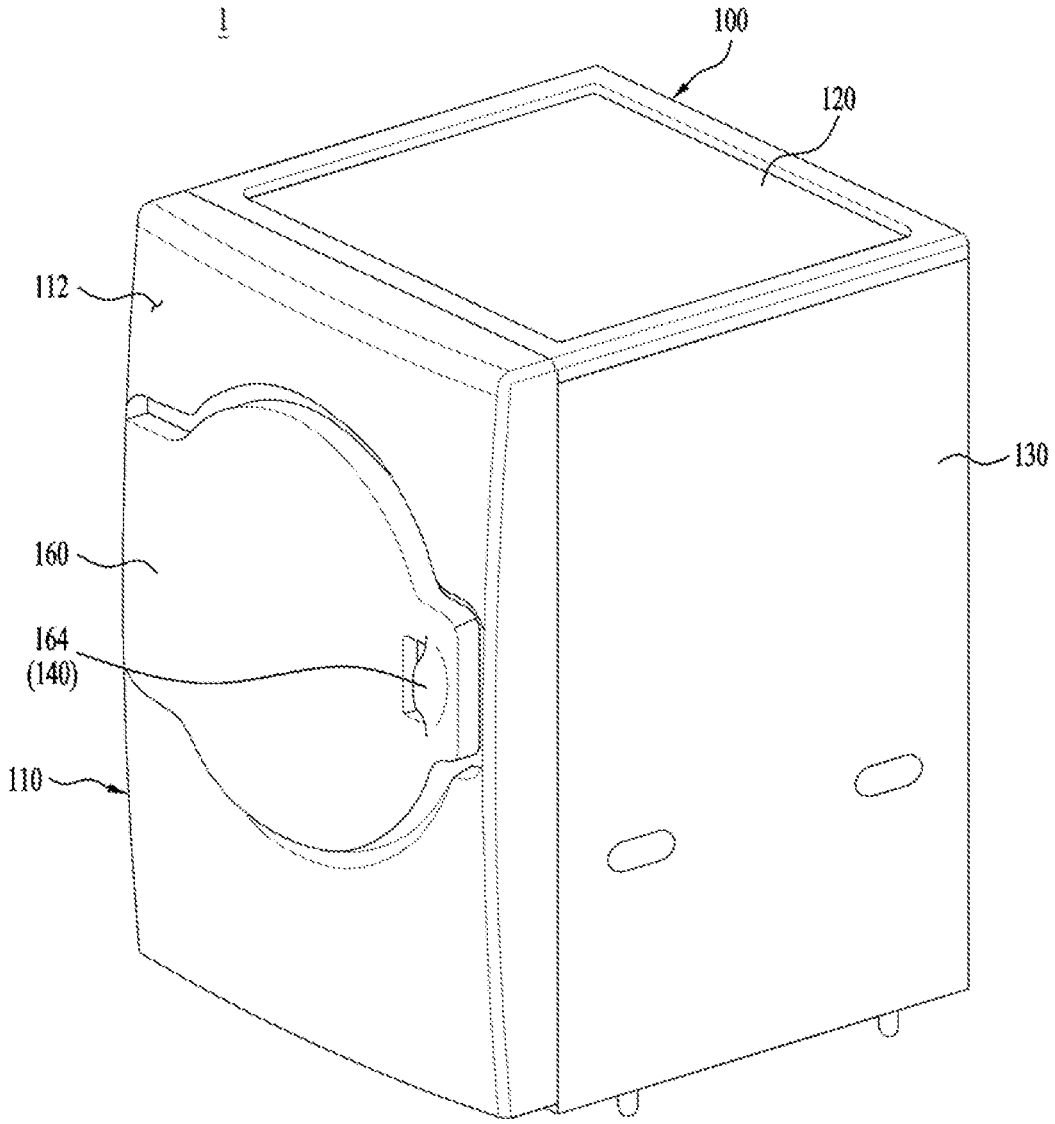
FIG. 2 is a perspective view of an example washing machine.
Figure 3:
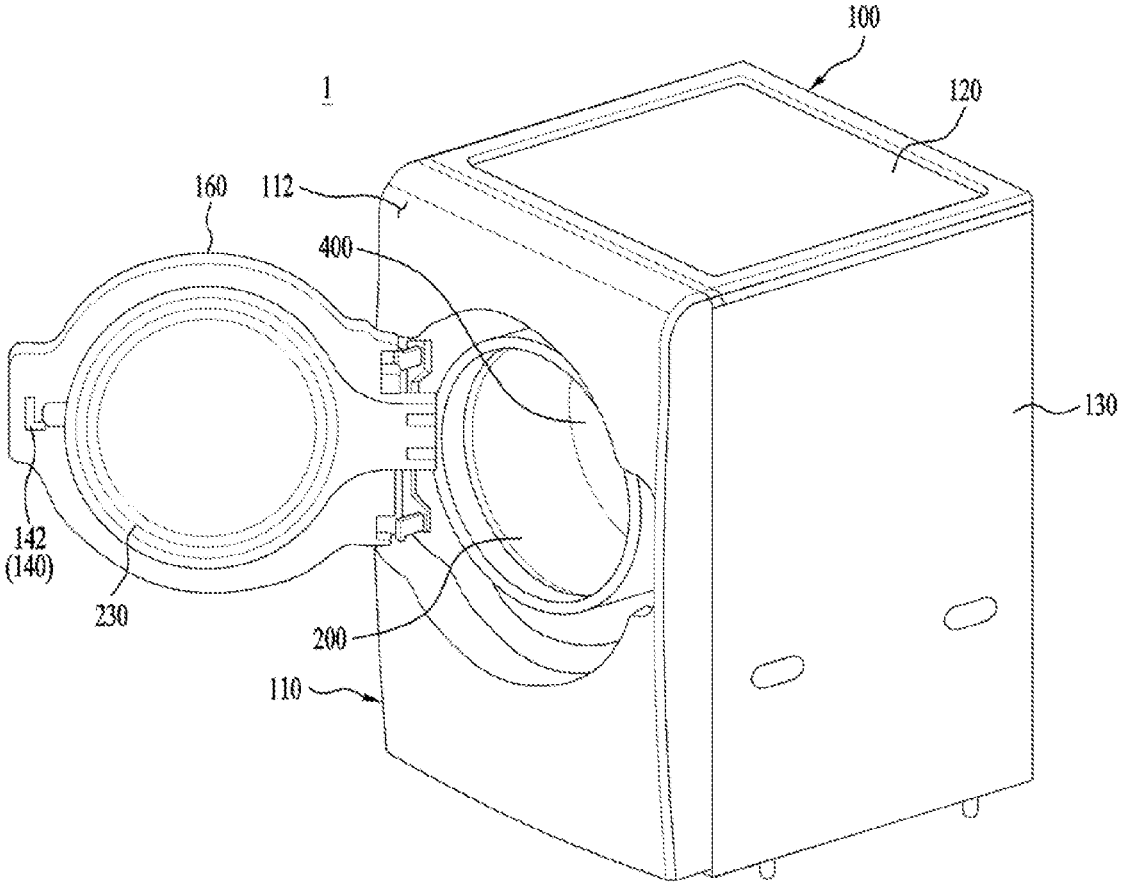
FIG. 3 is a perspective view of an example washing machine with an open door.

FIGS. 2 and 3 illustrate example washing machines.

As illustrated in FIGS. 2 and 3, the washing machine 1 includes a cabinet 100 defining the appearance of the washing machine, a tub 200, which is supported by a suspension such as a damper and/or a spring in the cabinet 100 so as to contain washing water, a drum 400 rotatably disposed in the tub 200 so as to contain laundry, and a drive unit for rotating the drum 400.

The cabinet 100 may include a front cabinet 110 defining the front part of the washing machine, right and left cabinets 130 defining the right and left parts of the washing machine, and an upper cabinet 120 defining the upper part of the washing machine.

Here, the front cabinet 110 is provided at the center thereof with a first introduction port 114, through which laundry is introduced into the loading space in the drum 400, and the first introduction port 114 is provided with a cabinet door 160 for opening and closing the first introduction port 114.

The front cabinet 110 may be provided above the first introduction port 114 with a control panel 112, which includes manipulation and display parts for controlling and displaying the overall operation of the washing machine 1.

The tub 200 is provided at the front face thereof with a second introduction port 210, which is open so as to allow laundry, introduced through the first introduction port 114, to be loaded into the drum 400. The second introduction port 210 is provided with a tub door 230 for opening and closing the second introduction port 210.

The tub 200 is inclined at a predetermined angle such that the second introduction port 210 is inclined upward so as to allow laundry to move during rotation of the drum and so as to allow laundry to be easily introduced and taken out of the drum by a user.

In addition to the inclined installation of the tub 200, the drum 400 is also disposed in the tub 200 in the state of being inclined at the same angle of inclination as that of the tub 200.

The angle of inclination, at which the tub 200 and the drum 400 are installed, is within a range of 5-15 degrees. In some implementations, the angle of inclination of the tub 200 and the drum 400 may be about 10 degrees in consideration of user's convenience and washing performance.

Hereinafter, the front cabinet and the tub, will be described in detail with reference to FIGS. 4 and 5 that illustrate example cabinet doors.

Figure 4:
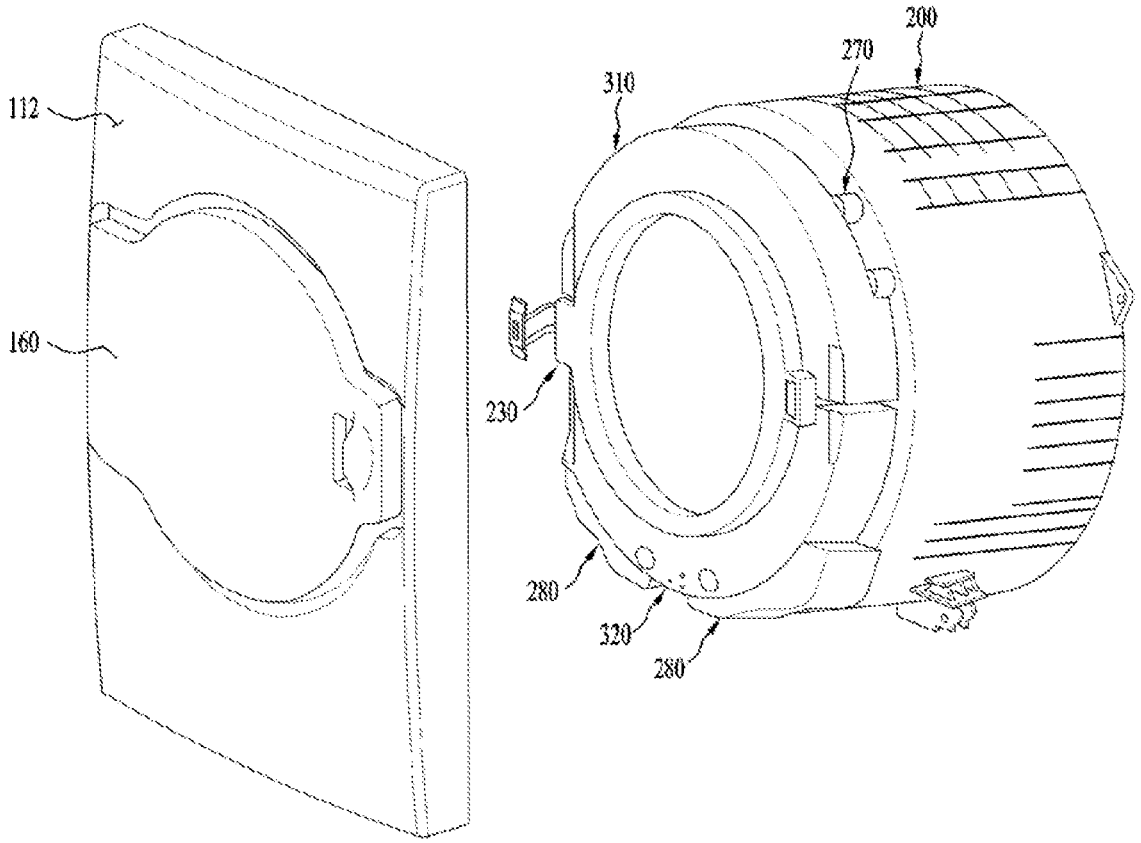
FIG. 4 is a perspective view of an installed state of an example cabinet door and an example tub door.
Figure 5:
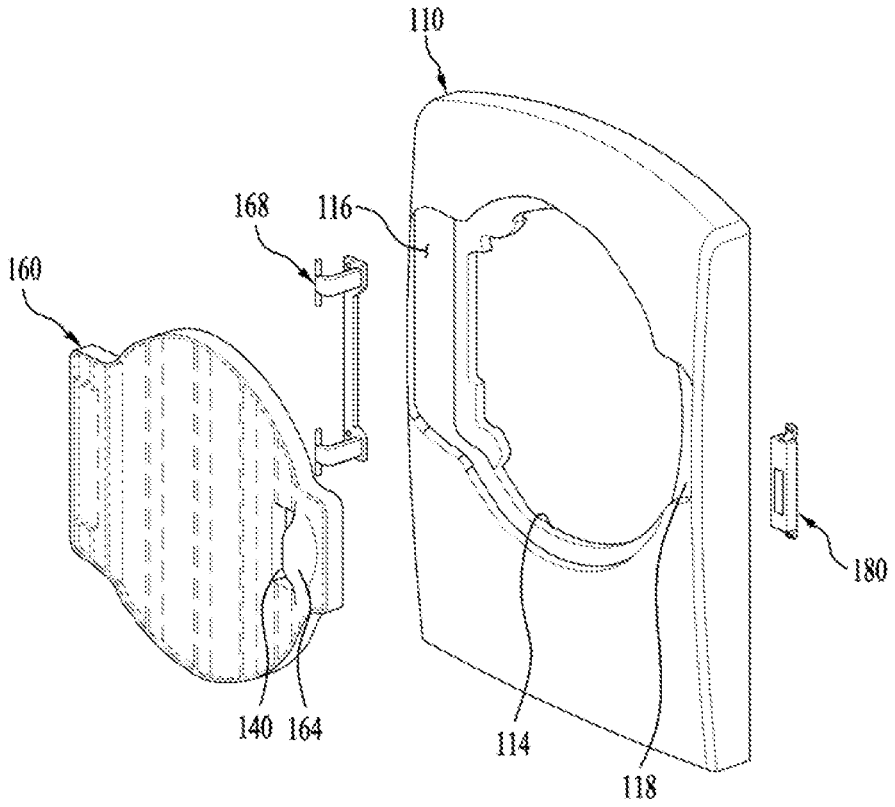
FIG. 5 is an exploded perspective view of an installed state of an example cabinet door.

As illustrated in FIGS. 4 and 5, the first introduction port 114, which is formed in the front cabinet 110, is provided at a first side thereof with a cabinet hinge mount 116, which is pressed into the front cabinet 110 so as to allow the cabinet door 160 to be rotatably mounted thereon. The first introduction port 114 is provided at a second side opposite the cabinet hinge mount 116 with a cabinet door lock mount 118 so as to allow the locked state of the cabinet door 160 to be set.

A cabinet door lock 180 is mounted in the cabinet door lock mount 118 so as not to protrude outward from the front cabinet 110. The cabinet door 160 is provided at a second side thereof with a handle 164 for opening and closing of the cabinet door 160.

The handle 164 is provided therein with a lock-releasing device 140 for locking and releasing the cabinet door 160 and the tub door 230. The lock-releasing device 140 is configured to concurrently release both the cabinet door 160, which is locked by the cabinet door lock 180, and the tub door 230, which is locked by the tub door lock 260. The lock-releasing device 140 will be described later together with the cabinet door 160.

Figure 6:
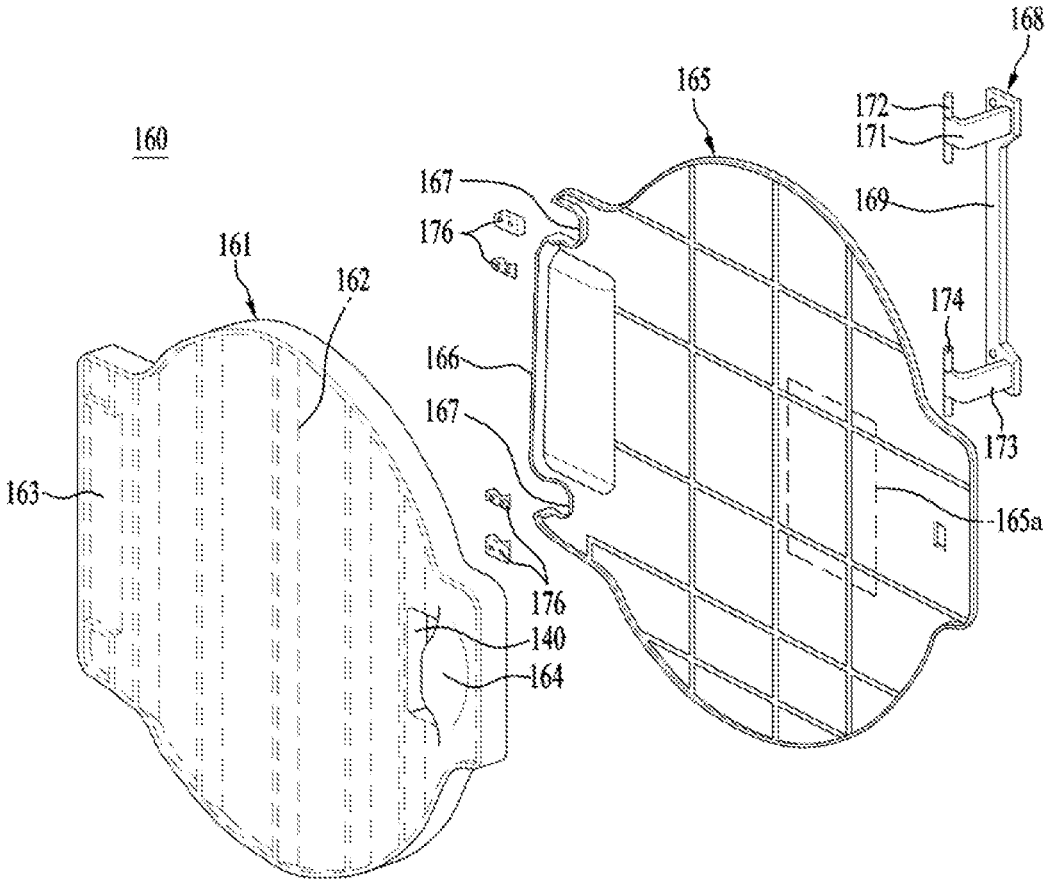
FIG. 6 is an exploded perspective view of an example cabinet door of a washing machine.

As illustrated in FIG. 6, the cabinet door 160, which is rotatably provided at the first introduction port 114 of the front cabinet 110 so as to open and close the first introduction port 114, includes a first outer frame 161 for constituting the outer part of the cabinet door 160, a first inner frame 165 for constituting the inner part of the cabinet door 160, and a first hinge unit 168 for rotatably supporting the cabinet door 160.

The first outer frame 161 and the first inner frame 165 may be coupled to each other by means of fastening elements such as bolts, and may be made from a transparent material so as to allow the operational state inside the washing machine 1 to be checked from the outside.

The outer surface of the cabinet door 160 (e.g. the outer surface of the first outer frame 161) may be configured to serve as an extended surface of the front cabinet 110, which extends along the outer surface of the front cabinet 110. The handle 164 for opening and closing the cabinet door 160 is disposed at the second side, opposite the first hinge unit 168.

The first outer frame 161 may be provided on the inner surface thereof with a plurality of reinforcing ribs 162 for increasing the strength of the first outer frame 161.

The cabinet door 160 is provided at the first side thereof with the first hinge unit 168, which is mounted on the cabinet hinge mount 116 so as to rotatably support the cabinet door 160.

The handle 164, which is formed on the first outer frame 161, is provided therein with the lock-releasing device 140, which engages with the cabinet door lock 180 when the first introduction port 114 is closed by the cabinet door 160, and which releases the locked state of the cabinet door lock 180 in response to a user's manipulation. The lock-releasing device 140 will be described later together with the cabinet door lock 180.

The first outer frame 161 includes a projection 163 at which the first hinge unit 168 is installed, and the first inner frame 165 includes a projection 166, which is disposed at a position corresponding to the projection 163 of the first outer frame 161.

The first inner frame 165 is provided above and below the projection 166 with a pair of recesses 167, in which upper and lower rotators 171 and 173 of the first hinge unit 168, which will be described later, are received. Each of the pair of recesses 167 is provided with a pair of brackets 176 for rotatably supporting an upper or lower rotating shaft 172 or 174 of the first hinge unit 168, which will be described later.

The projection 166, the recesses 167 and the brackets 176, which are provided at the first inner frame 165, are covered by the projection 163 of the first outer frame 161 so as not to be visible from the outside when the first outer frame 161 is combined with the first inner frame 165.

The first hinge unit 168 includes a hinge body 169 coupled to the cabinet hinge mount 116 formed at the first introduction port 114, the upper and lower rotators 171 and 173, which respectively extend from the upper and lower ends of the hinge body 169, and the upper and lower rotating shafts 172 and 174, which extend from respective ends of the upper and lower rotators 171 and 173.

The upper and lower rotators 171 and 173, which are formed on the hinge body 169 of the first hinge unit 168, may be spaced apart from each other by a predetermined interval. In some implementations, the upper and lower rotators 171 and 173 are spaced apart from each other by a predetermined interval so as not to overlap a second hinge unit 250 of the tub door 230, which will be described later, and a second hinge unit 250 of the tub door 230 is disposed between the upper and lower rotators 171 and 173.

The door lock mount 118, which is provided at the second side of the first introduction port 114 of the front cabinet 110, is provided with the cabinet door lock 180, into which a cabinet door hook 142 of the lock-releasing device 140 is fitted and locked.

The cabinet door 160 may be inclined at a predetermined angle so as to facilitate the closing rotation of the cabinet door 160. If the rotating axis of the first hinge unit 168 is vertically positioned, it is difficult for the opened cabinet door 160 to be rotated by gravity.

When the rotating axis of the first hinge unit 168 is inclined in the forward or rearward direction of the front cabinet 110, the cabinet 160 coupled to the first hinge unit 168 may be rotated by its own weight in one direction (e.g. in the direction in which the cabinet door 160 is opened) or in the opposite direction (e.g. in the direction in which the cabinet door 160 is closed) depending on the opened position of the cabinet door 160.

The washing machine will be described based on the state in which the upper end of the rotating axis of the first hinge unit 168 is inclined in the rearward direction of the front cabinet 110 (e.g. in the inward direction of the washing machine 1) at a predetermined angle. The angle of inclination of the rotating axis of the first hinge unit 168 is within a range of about 1.5-3.5 degrees, and typically about 2.5 degrees.

In some implementations, when the cabinet door 160 is opened to an angle less than the predetermined angle, the cabinet door 160 is rotated by its own weight in the direction in which the cabinet door 160 is closed. When the cabinet door 160 is opened to an angle equal to or greater than the predetermined angle, the cabinet door 160 is rotated in the direction in which the cabinet door 160 is opened.

Figure 7:
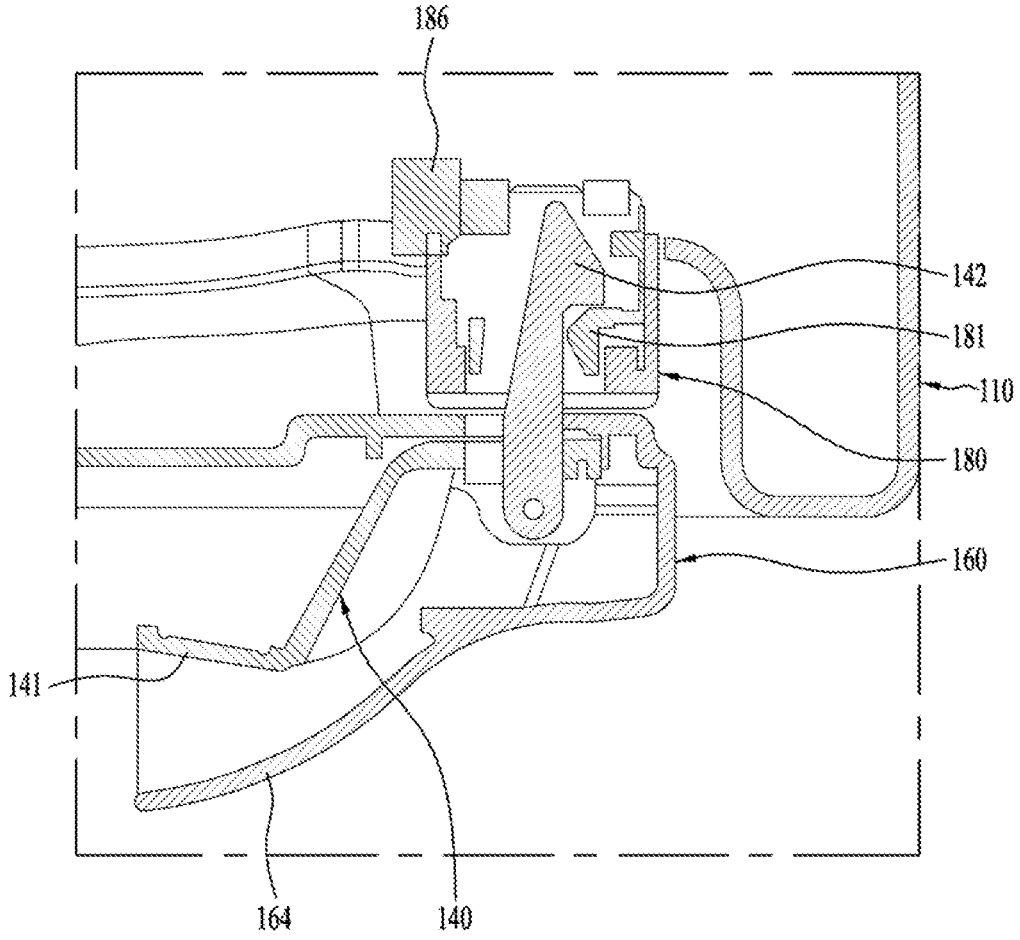
FIG. 7 is a cross-sectional view of an example lock-releasing device of a washing machine.
Figure 8:
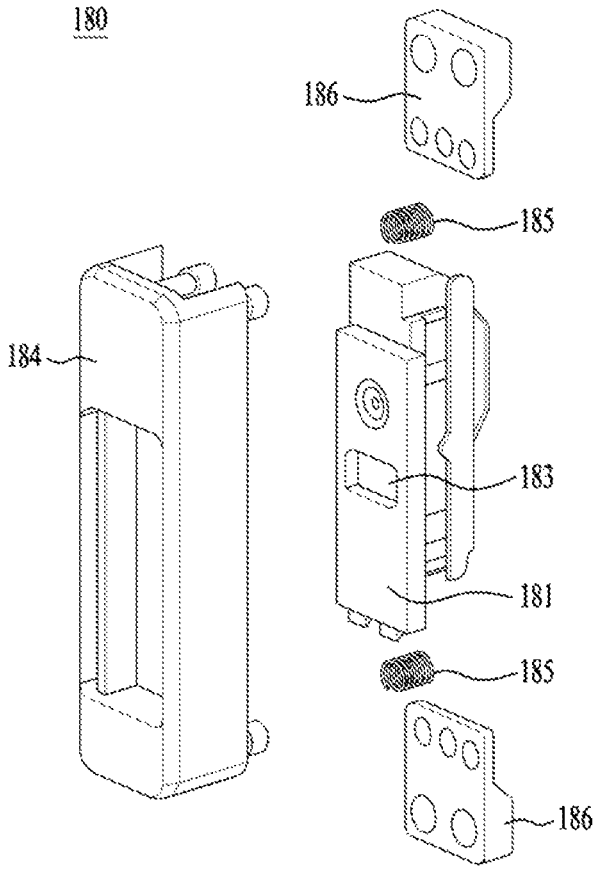
FIG. 8 is an exploded perspective view of an example cabinet door lock of a washing machine.

Hereinafter, the lock-releasing device 140 and the cabinet door lock 180 will be described in detail with reference to FIGS. 7 and 8. FIG. 7 illustrates an example lock-releasing device. FIG. 8 illustrates an example cabinet door lock 180.

As illustrated in FIG. 7, the lock-releasing device 140 is disposed inside the handle 164 so as to release the locked state of the cabinet door lock 180 by a user's pulling force when a user grasps the handle 164 to open the cabinet door 142. The lock-releasing device 140 includes a release lever 141, a cabinet door hook 142, which is locked by the cabinet door lock 180 when the first introduction port 114 of the cabinet door 160 is closed and which is released from the state of being locked to the cabinet door lock 180 when the release lever 141 is pulled, and a torsional spring 143 for elastically biasing the cabinet door hook 142 in the direction in which the cabinet door hook 142 is engaged with the cabinet door lock 180.

As illustrated in FIGS. 7 and 8, the cabinet door lock 180 is intended to control the locked state of the cabinet door 160, which is coupled to the first introduction port 114. The cabinet door lock 180 includes a hook holder 181 secured to the cabinet door lock mount 118 of the front cabinet 110, a hook fitting portion 183, which is disposed outside the cabinet door lock mount 118 and which is coupled to the hook holder 181 so as to be movable in the direction in which the cabinet door hook 142 is fitted, an elastic support 184 for elastically supporting the hook fitting portion 183 in the direction opposite the direction in which the cabinet door hook 142 is fitted, and a lock-releasing switch 186 for detecting the action of the cabinet door hook 142 when the locked state in which the cabinet door hook 142 is engaged with the hook holder 181 is released. The lock-releasing switch 186 generates an electrical signal for activation of a tub door releaser 220 (see FIG. 10), which will be described later.

The cabinet door lock 180 has a moving space such that the hook fitting portion 183 is elastically displaced in the moving space by the elastic support 184 after the cabinet door hook 142 is engaged with the hook holder 181 when the cabinet door 160 is closed. By virtue of the moving space, after the cabinet door 160 is locked by the hook holder 181 of the cabinet door lock 180, the tub door 230 is further pushed so as to be closed. The interlocking structure between the cabinet door 160 and the tub door 230 will be described in detail when the operation of the cabinet door 160 and the tub door 230 is described.

Figure 9:
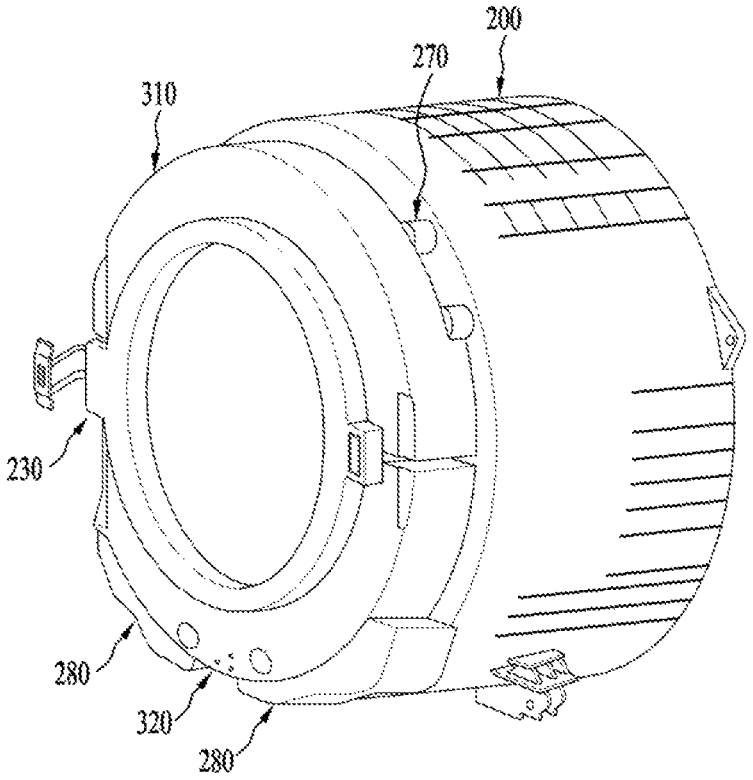
FIG. 9 is a perspective view of an example tub and an example tub door of a washing machine.
Figure 10:
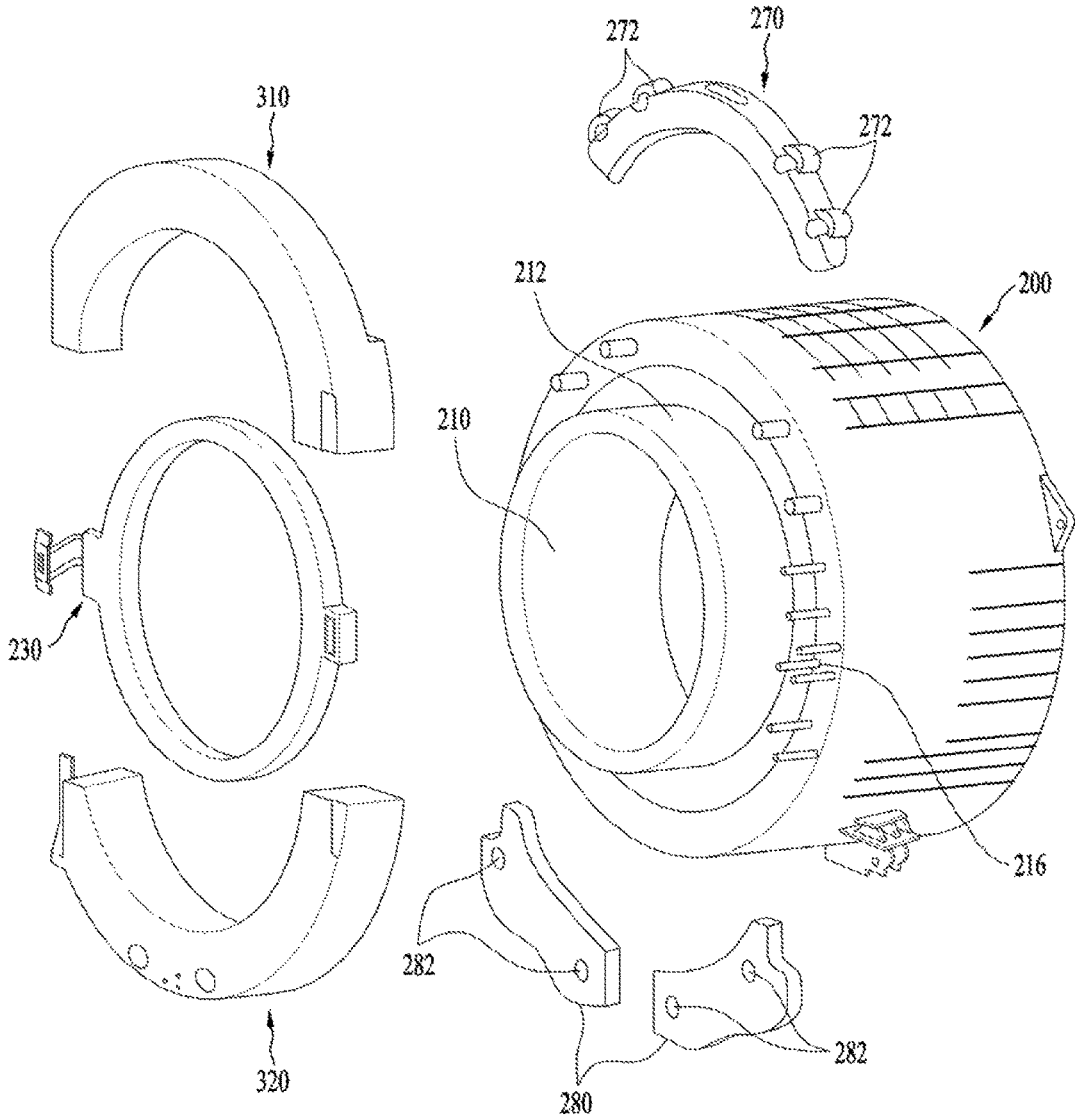
FIG. 10 is an exploded perspective view of an example tub and an example tub door of a washing machine.
Figure 11:
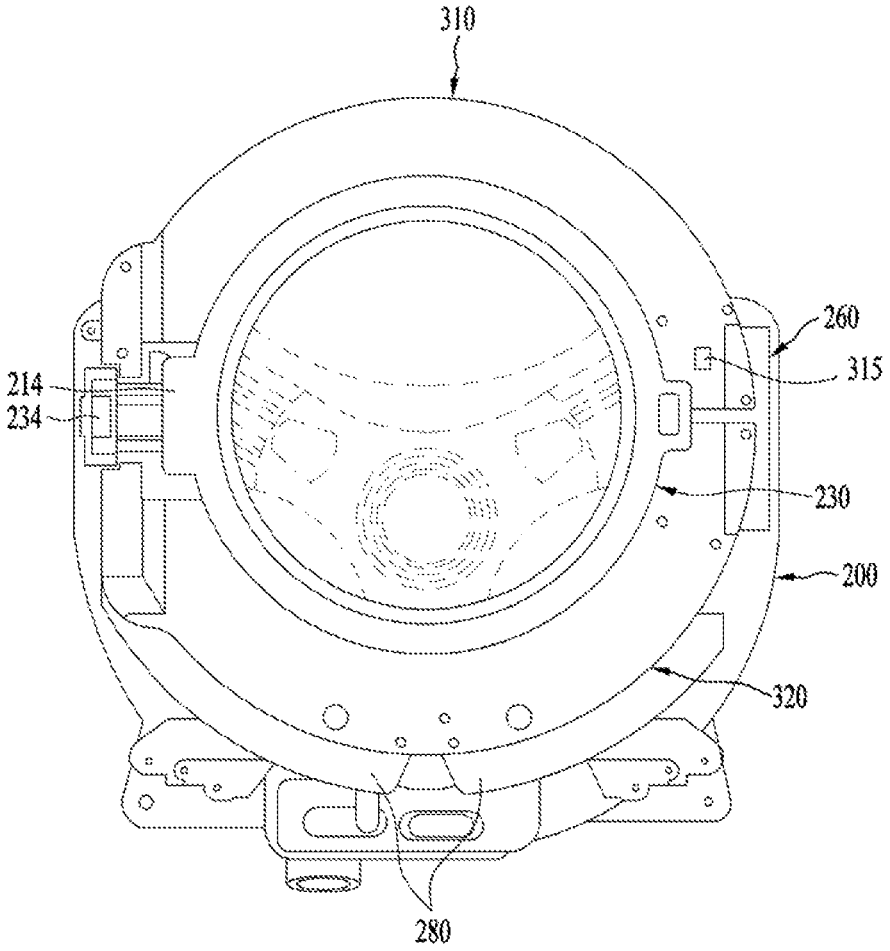
FIG. 11 is a front view of an example tub and an example tub door of a washing machine.
Figure 12:
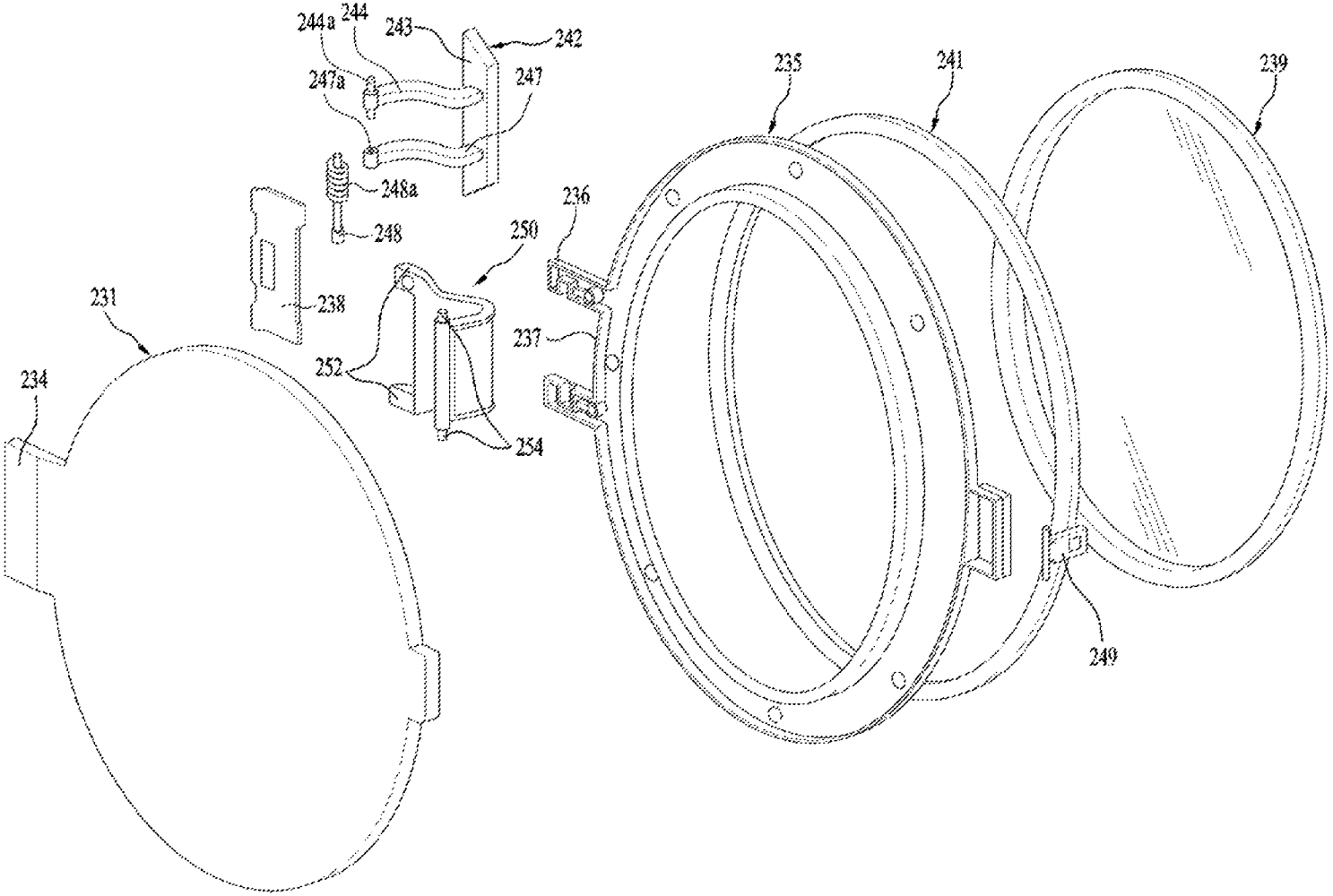
FIG. 12 is an exploded perspective view of an example tub door of a washing machine.
Figure 13:
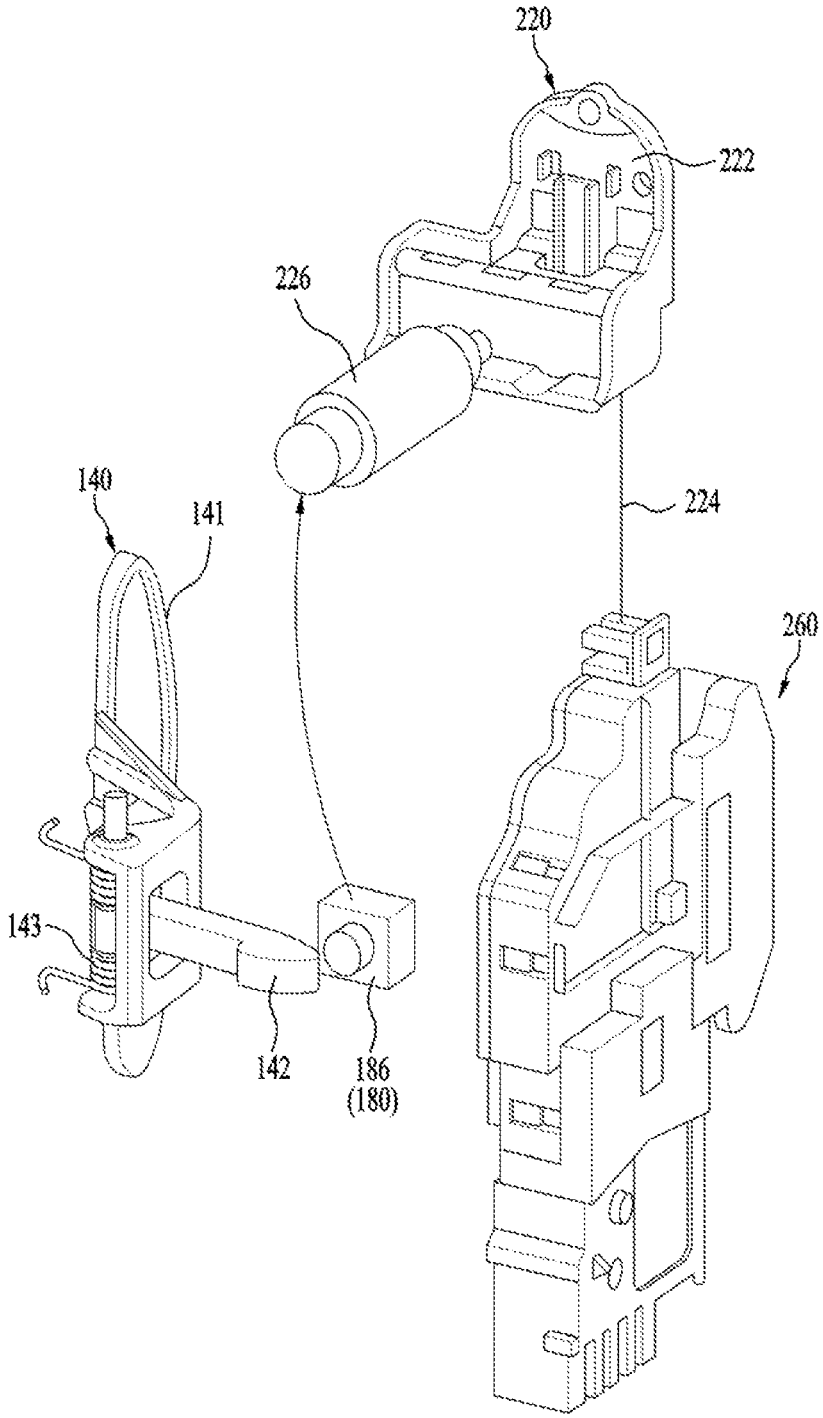
FIGS. 13 to 15 are conceptual views illustrating example lock-releasing devices of a washing machine.

FIGS. 9 to 11 illustrate an example tub. FIG. 12 illustrates an example tub door. FIG. 13 illustrates an example push roller.

As illustrated in FIGS. 9 to 11, the tub 200 is provided at the front face thereof with the second introduction port 210, which is positioned on the extended line of the first introduction port 114 in the state of being separated from the first introduction port 114 of the cabinet 100 so as to allow laundry to be introduced into the tub 200 therethrough. The second introduction port 210 is provided with a ring-shaped rim 212, which extends toward the first introduction port 114 of the front cabinet 110. The rim 212 is provided therearound with a pair of weight balancers 270 and 280, which are intended to increase the weight of the tub 200 so as to prevent vibration of the tub 200. The rim 212 is further provided therearound with a pair of cover members 310 and 320 for covering the pair of weight balancers 270 and 280 and other structures of the front part of the tub 200. The second introduction port 210 is provided at a first side thereof with the tub door 230, which is separated from the cabinet 100 so as to open and close the second introduction port 210 of the tub 200.

The rim 212 is provided at a first side thereof with a second hinge mount 214, which is projected so as to allow the second hinge unit 250 to be mounted thereon, and is provided at a second side thereof with a tub door lock mount 216, on which is mounted the tub door lock 260 for setting the locked state of the tub door 230, which is adapted to open and close the second introduction port 210.

The rim 212 is disposed in the space between the tub 200, which is obliquely installed, and the front cabinet 110, so as to connect them to each other. Since the tub 200 is inclined at a predetermined angle, the space between the second introduction port 210 of the tub 200 and the front cabinet 110 is configured to have an inverted triangular cross-section, which is larger at the upper portion than the lower portion thereof. In some implementations, the rim 212, which extends from the second introduction port 210, may extend further at the upper end than at the lower end thereof.

The angle of inclination of the end of the rim 212 is such that the upper end of the rim 212 is inclined toward the tub 200 at 1.5-3.5 degrees, and typically about 2.5 degrees, with respect to the vertical plane, which extends through the lower end of the rim 212. The configuration of the rim 212 is intended to increase the washing space, which is defined between the front face of the tub 200 and the tub door 230 for opening and closing the rim 212, thereby increasing the washing capacity of the tub 200. When the rim 212 of the tub 200 is inclined at a predetermined angle, as described above, the tub door 230, which is coupled to the rim 212, is also inclined at an angle corresponding to the angle of inclination of the rim 212. The tub door 230 is coupled to the rim 212 at an angle of inclination of 1.5-3.5 degrees, and typically at about 2.5 degrees, which is the same as the angle of inclination of the end of the rim 212.

The rim 212 of the tub 200 is provided therearound with the plurality of weight balancers 270 and 280, which are intended to increase the weight of the tub 200 so as to increase the resistance to vibrations transmitted to the tub 200.

The weight balancers 270 and 280 may be configured to have forms corresponding to the front part of the tub 200. In some implementations, since the weight balancers 270 and 280 are mounted in the ring-shaped space between the outer circumferential surface of the tub 200 and the outer circumferential surface of the rim 212, they may be configured to define a ring or arcuate shape corresponding to the ring shape.

In some implementations, the tub 200 may be provided in front thereof with the water supply unit for supplying washing water to the tub 200, an air supply unit for supplying dry air and the like. When the water supply unit, the air supply unit and the like are provided in front of the tub 200, the weight balancers 270 and 280 may be configured to avoid interference with the provided structures.

The weight balancers 270 and 280 take divided forms, that is, an upper weight balancer 270 and a lower weight balancer 280 for ease of coupling. The tub 200 may be provided on the front surface thereof with coupling bosses for coupling the respective weight balancers 270 and 280 and that the weight balancers 270 and 280 be respectively provided with a plurality of coupling portions 272 and a plurality of coupling holes 282, which are coupled to the coupling bosses.

Since the water supply unit, the air supply unit and the like are exposed from the space between the first introduction port 114 of the front cabinet 110 and the second introduction port 210 of the tub 200, the weight balancers 270 and 280 are directly exposed to the outside upon use of the washing machine, which is undesirable. Hence, there is a need to prevent the respective weight balancers 270 and 280, the water supply unit, the air supply unit and the like from being exposed through the space between the first introduction port 114 of the front cabinet 110 and the second introduction port 210 of the tub 200.

In some implementations, the weight balancers 270 and 280 may be provided thereover with the plurality of cover members 310 and 320 for preventing the weight balancers 270 and 280, the water supply unit, the air supply unit and the like from being directly exposed to the outside. The cover members 310 and 320 may include an upper cover member 310 and a lower cover member 320 for respectively covering the upper weight balancer 270 and the lower weight balancer 280. Each of the upper cover member 310 and the lower cover member 320 may be divided into one or more segments for assembly efficiency and shielding of other components.

As illustrated in FIG. 11, the front circumferential region of the tub 200 (e.g. the space between the front circumferential surface of the tub 200 and the rim 212 of the second introduction port 210) is covered by the upper cover member 310 and the lower cover member 320. When the cabinet door 160 of the front cabinet 110 is opened, the space between the first introduction port 114 of the front cabinet 110 and the rim 212 of the second introduction port 210 is covered by the upper cover member 310 and the lower cover member 320 so as not to be exposed from the first introduction port 114 of the front cabinet 110 (see FIG. 15).

In addition, one of the upper cover member 310 and the lower cover member 320 is provided with an exposed release button 315 for releasing the locked state of the tub door lock 260, which will be described later. In some implementations, the release button 315 is provided at an area of the upper cover member 310 near the cabinet door lock 260. The release button 315 will be set forth in detail in the description of the tub door lock 260

The tub 200 is provided at a first side of the front part thereof with the second hinge unit 250 so as to enable the tub door 230 to open and close the second introduction port 210. The tub 200 is provided at a second side of the front part thereof with the tub door lock 260 (see FIG. 13) for setting the locked state of the tub door 230. The tub door lock 260 is provided thereabove with the tub door lock releaser 220 (see FIG. 13) for releasing the locked state of the tub door lock 260.

The tub door 230, the tub door lock 260 and the tub door lock releaser 220 are not structurally connected to the cabinet 100, and the tub 200 is supported by a suspension that is structurally independent of the cabinet 100. In some implementations, since only the suspension is provided between the tub 200 and the cabinet 100 without using a gasket such as that of the conventional washing machine 1 illustrated in FIG. 1, vibrations of the tub 200 are transmitted only to the suspension, thereby remarkably reducing the transmission of vibrations of the tub 200 to the cabinet 100.

As illustrated in FIG. 12, the tub door 230 includes a second outer frame 231 defining the outer surface of the tub door 230, a second ring-shaped inner frame 235, which defines the outer circumferential surface of the tub door 230 and has a bore, a ring-shaped ring seal 241, which is disposed between the second outer frame 231 and the second inner frame 235 so as to create a seal between the second introduction port 210 of the tub 200 and the tub door 230, and a transparent frame 239 fitted into the bore of the second inner frame 235 so as to enable the inside of the tub 200 or the drum 400 to be checked from the outside.

The second inner frame 235 is provided at the first side thereof with a projection 236, on which the second hinge unit 250 is mounted. The projection 236 has a rotational hinge link 251 of the second hinge unit 250 rotatably coupled thereto, which will be described later. The second inner frame 235 is provided at the inner surface thereof with a holding bracket 238 for rotatably coupling the rotational hinge link 251, which is received in a recess 237, thereto. The second inner frame 235 is provided at a second side thereof with a tub door hook 249, which is fitted into the tub door lock 260, which will be described later, so as to maintain the locked state of the tub door 230.

The second hinge unit 250 is mounted on the second hinge mount 214, which is provided at the first side of the rim 212 of the second introduction port 210, so as to rotatably support the tub door 230. The second hinge unit 250 includes at least one rotating shaft, which is spaced apart from the rotating shaft of the cabinet door 160. The second hinge unit 250 rotatably supports the tub door 230 such that the tub door 230 is rotated at a radius of rotation similar to that of the cabinet door 160. In other words, the second hinge unit 250 supports the tub door 230 such that the tub door 230 is rotated about a rotating shaft that is different from the rotating shaft of the cabinet door 160. The reason for this is to offer visual unity between the cabinet door 160 and the tub door 230 by aligning the center of the cabinet door 160 with the center of the tub door 230 when the tub door 230 is opened or closed.

The second hinge unit 250 includes a stationary hinge link 242 mounted on the second hinge mount 214, a rotational hinge link 251, which is rotatably coupled at one end thereof to the stationary hinge link 242 and is rotatably coupled at the other end thereof to the tub door 230, and an elastic rotating shaft 248 for allowing the rotational hinge link 251 to be rotated with respect to the stationary hinge link 242 and for elastically biasing the rotational hinge link 251 in the direction in which the tub door 230 is opened.

The stationary hinge link 242 includes a mount body 243 coupled to the second hinge mount 243 of the tub 200, and upper and lower links 244 and 247, which are projected and extend from the surface of the mount body 243 and are spaced apart from each other. The upper link 244 is provided at the end thereof with a rotating shaft 244*a*, which is rotatably fitted into one end of the rotational hinge link 251, and the lower link 247 is provided at the end thereof with a rotating shaft hole 147*a*, into which the elastic rotating shaft 248 is rotatably fitted. In some implementations, a portion of the rotational hinge link 251 is disposed between the upper link 244 and the lower link 247, and is rotatably supported by the rotating shaft 144*a* of the upper link 244 and the elastic rotating shaft 248 fitted into the lower link 247, whereby the rotational hinge link 251 is elastically biased in the direction in which the tub door 230 is opened.

The rotational hinge link 251 includes a first rotating part 252, which is positioned at a first side of the rotational hinge link 251 and is rotatably disposed between the upper link 244 of the stationary hinge link 242, and a second rotating part 254, which is positioned at a second side of the rotational hinge link 251 and is rotatably coupled to the tub door 230. The intermediate part, which is disposed between the first rotating part 252 and the second rotating part 254, is bent at a predetermined angle in the direction in which the tub door 230 is opened.

Figure 17:
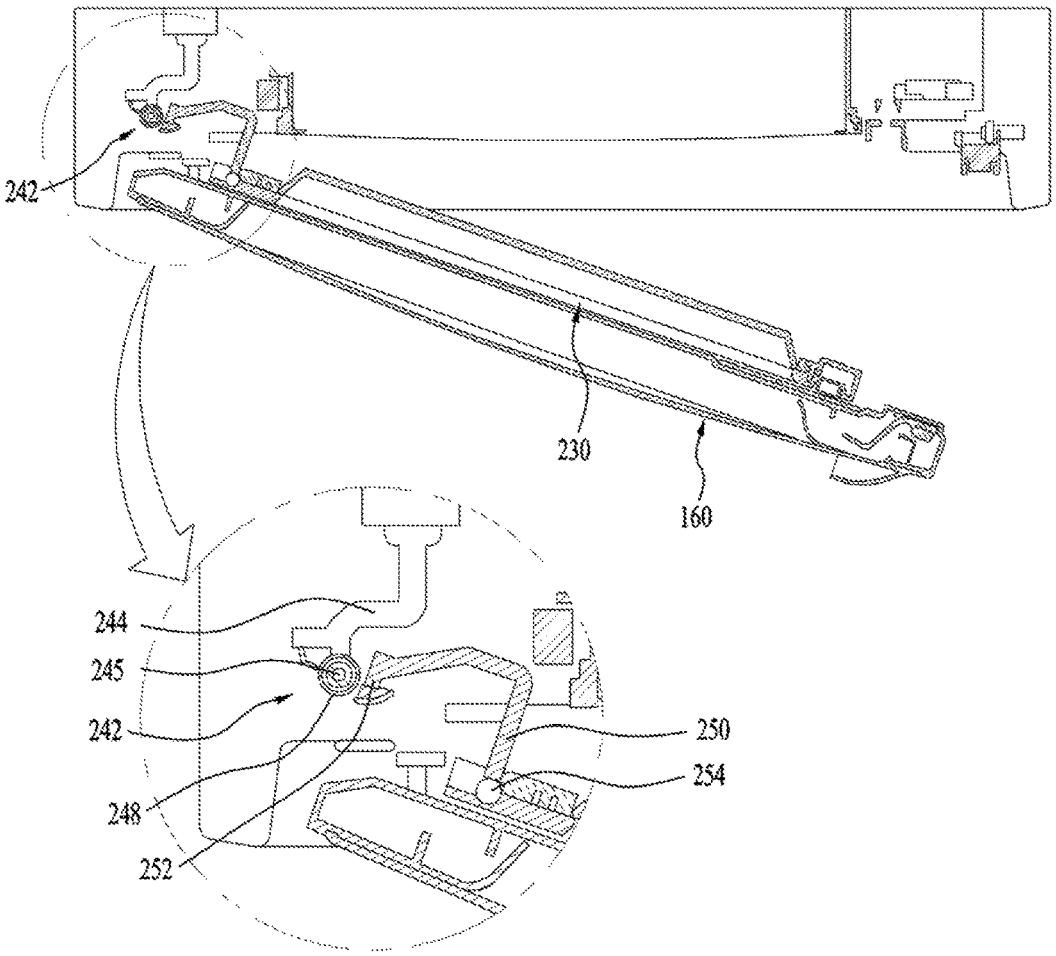

The first rotating part 252 of the rotational hinge link 251 is rotatably coupled to the stationary hinge link 242 so as to be rotated within a predetermined angular range of 20-40 degrees, and typically at about 30 degrees, in the direction in which the tub door 230 is opened (see FIG. 17). In some implementations, after the rotational hinge link 251 is rotated at about 40 degrees with respect to the stationary hinge link 242, the tub door 230 is rotated with respect to the rotational hinge link 251. The tub door 230 is rotatably coupled to the second rotating part 254 of the rotational hinge link 251, and the tub door 230 is restricted so as to be rotated only within an angular range of 80-110 degrees in the direction in which the tub door 230 is rotated (see FIG. 18).

In some implementations, the tub door 230, which is supported by the second hinge unit, is opened to an angle of 100-150 degrees, and typically an angle of 120 or more, by rotation of the stationary hinge link 242 and the rotational hinge link 251.

The tub door lock mount 216, which is provided at the second side of the second introduction port 210 of the tub 200, is provided with the tub door lock 260, into which the tub door hook 249 of the tub door 230 is fitted and locked, and is provided near the second introduction port 210 with the tub door lock releaser 220, which is actuated by the lock-releasing device 140 so as to release the locked state of the tub door lock 260.

The tub door lock releaser 220 is intended to release the locked state of the tub door lock 260 in response to a lock-releasing signal generated by the lock-releasing device 140. The tub door lock releaser 220 includes a solenoid 226 (see FIG. 13), which is actuated in response to a signal generated by the lock-releasing switch 186, a rotator 222, which is rotated by actuation of the solenoid 226, and a tension cable 224 for transmitting the rotational force of the rotator 222 to the tub door lock 260.

The tub door lock 260, which is intended to control the locked state of the tub door 230 provided at the second introduction port 210, includes the hook holder 181, secured to the tub door lock mount 216 near the second introduction port 210, and a cable connector 261 connected to the tension cable 224 of the tub door lock releaser 220 near the hook holder 181.

Although the tub door lock releaser 220 and the tub door lock 230 have been described as being configured to be separated from each other, the solenoid 226 of the tub door lock releaser 220 may be directly provided at the tub door lock 260 so as to release the locked state of the tub door lock 260 in response to the signal from the lock-releasing switch 186.

The tub door lock 260 is configured such that the locked state of the tub door 230 is released by actuation of the solenoid 226 when the cabinet door 160 is opened. However, when the solenoid 226 malfunctions or breaks, the tub door lock 260 may not be operated due to the defective solenoid 226. In some implementations, the upper cover member 310

Figure 14:
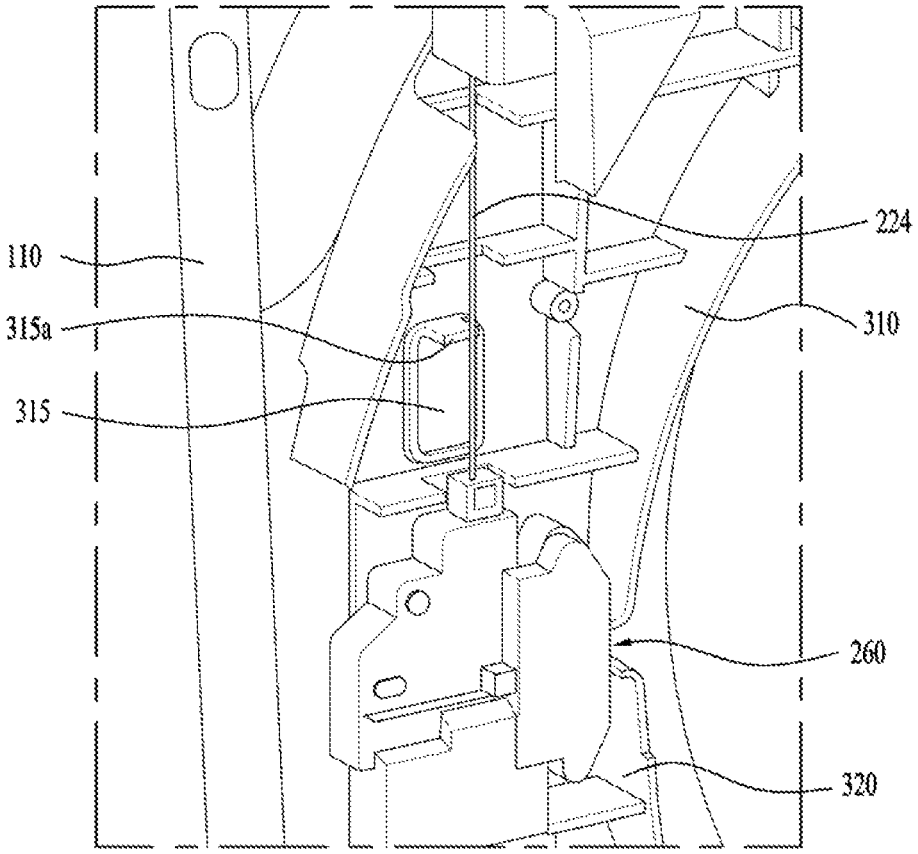
Figure 15:
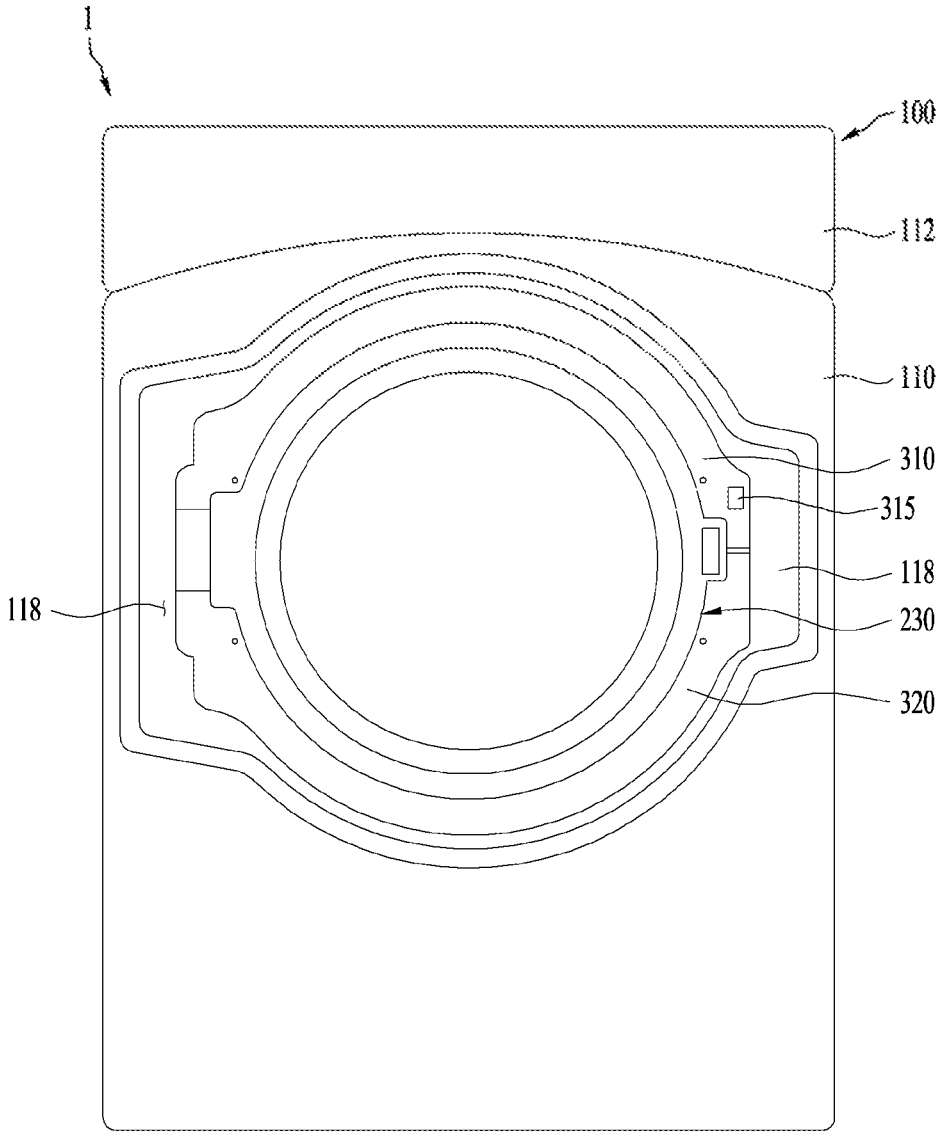

(or a predetermined area of the front cabinet 110) is provided with a release button 315 for opening the tub door 230 when the solenoid 226 malfunctions or breaks. As illustrated in FIGS. 14 and 15, the release button 315 is positioned near the tension cable 224, and includes a pushing protrusion 315*a* adapted to press a predetermined portion of the tension cable 224 by pushing the release button 315. In other words, when the release button 315 is pushed, the pushing protrusion 315*a* of the release button 315 presses the predetermined portion of the tension cable 224, thereby providing the tension cable 224 with a tensile force. As a result, the cable connector 261 of the tub door lock 260, connected to the tensile cable 224, is moved so as to release the locked state of the tub door 230.

The operation of an example washing machine will now be described in detail with reference to the accompanying drawings. The respective elements, which will be mentioned below, should be understood with reference to the above description and the accompanying drawings.

Figure 16:
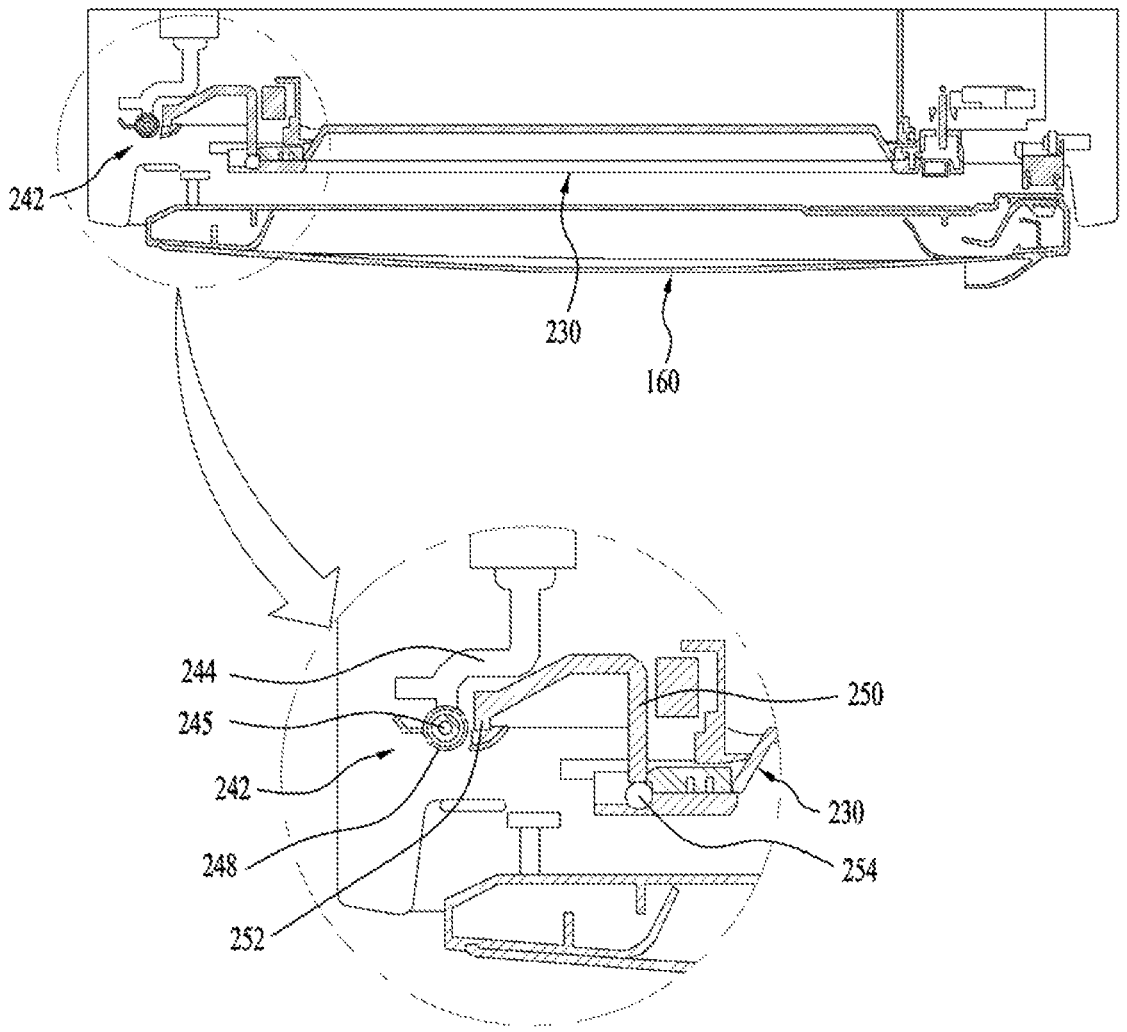
FIGS. 16 to 18 are fragmentary cross-sectional views of an example opening operation of a washing machine.
Figure 18:
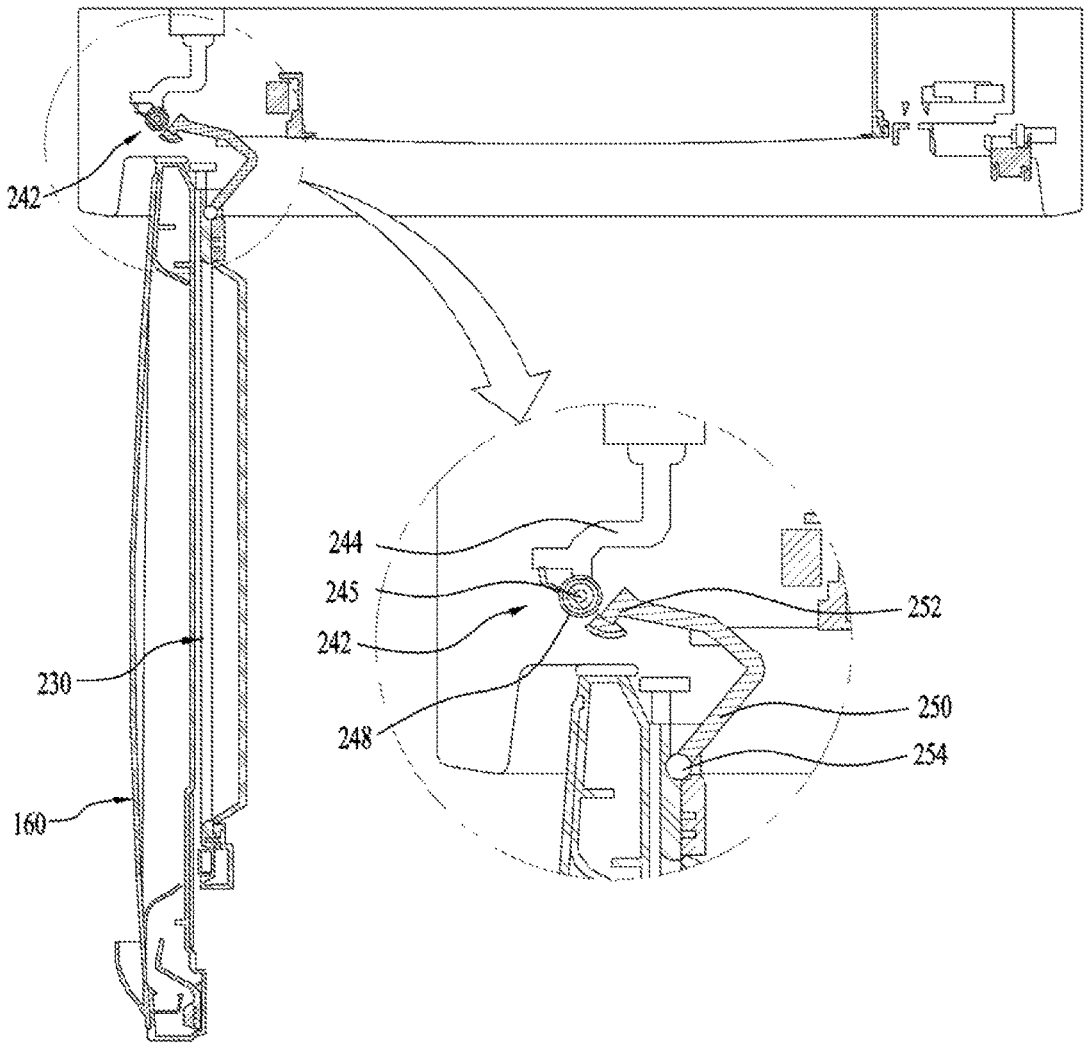

Hereinafter, the operation of opening respective doors will be described with reference to FIGS. 16 to 18. FIGS. 16 to 18 illustrate an example operation of opening a door of a washing.

Prior to describing the operation of opening the cabinet door 160 and the tub door 230, the locked state of the cabinet door 160 and the tub door 230 is first described. The cabinet door 160 is maintained in the locked state by engagement of the cabinet door hook 175 of the cabinet door 160 with the cabinet door lock 180, and the tub door 230 is maintained in the locked state by engagement of the tub door hook 249 of the tub door 230 with the tub door lock 260 (see FIG. 16).

In order for a user to open the cabinet door 160 of the washing machine 1, a user grasps the handle 164 provided at the cabinet door 160 of the front cabinet 110 and applies force to the handle 164 in the direction in which the cabinet door 160 is opened. In some implementations, the release lever 141 of the lock-releasing device 140 provided inside the handle 164 is rotated, and the locked state of the cabinet door hook 142 is released. At this time, the release switch 186 of the cabinet door lock 180 detects the release of the locked state of the cabinet door hook 142.

The solenoid 226 of the cabinet door lock releaser 150 is actuated in response to the detection of the release switch so as to rotate the rotator 222. As the rotator 222 is rotated, the cable connector 261 of the tub door lock 260 connected to the tension cable 224 of the rotator 222 is actuated, whereby the locked state of the tub door hook 249, secured to the hook holder 181 of the tub door lock 260, is released, and at the same time the locked state of the cabinet door 160 and the tub door 230 is released.

When the locked state of the cabinet door 160 and the tub door 230 is released, the tub door 230 is rotated in the opening direction by the torsional spring 248*a* provided at the second hinge unit 250 of the tub door 230. At this time, the tub door 230 pushes the cabinet door 160 in the opening direction, whereby the cabinet door 160 is opened by the tub door 230.

The tub door 230, which is supported by the second hinge unit 250, is opened in two rotation steps, that is, rotation of the rotational hinge link 251 and rotation of the tub door 230.

When the state in which the tub door 230 is locked by the tub door lock 260 is released, after the rotational hinge link 251, coupled to the first rotating part 252 of the second hinge unit 250, is first rotated about 30 degrees with respect to the stationary hinge link 242, the rotation of the rotational hinge link 251 is restricted (see FIG. 17).

Subsequently, the tub door 230, which is coupled to the second rotating part 254 of the rotational hinge link 251, is rotated to an angle of about 90 degrees with respect to the second rotating part 254 of the rotational hinge link 251, thereby completing the operation of opening the tub door 230 (see FIG. 18).

Hereinafter, the closing operation of the cabinet door 160 and the tub door 230 will be described. In order to close the cabinet door 160 and the tub door 230, a user rotates the cabinet door 160 in the closing direction. At this time, the cabinet door 160 pushes the tub door 230, and the cabinet door 160 and the tub door 230 are thus rotated in the closing direction, against the elastic force of the rotational spring 248*a* provided at the second hinge unit 250 of the tub door 230.

As the cabinet door 160 and the tub door 230 are rotated, the cabinet door hook 175 of the cabinet door 160 is fitted into the cabinet door lock 180, and at the same time, the tub door hook 249 of the tub door 230 is fitted into the tub door lock 260.

When the cabinet door hook 175 of the cabinet door 160 is fitted into the cabinet door lock 180 by the action of closing the cabinet door 160, performed by a user, the cabinet door hook 175 is completely engaged with the cabinet door lock 180 by the rotation of the cabinet door 160, while the hook fitting portion 183, into which the cabinet door hook 175 is fitted, is elastically supported by the spring. At this time, the tub door 230 is further moved by the distance corresponding to the distance that the hook fitting portion 183 of the cabinet door lock 180 is moved, and is engaged with the tub door lock 260.

Thereafter, the user's pushing force applied to the cabinet door 160 is released, and the hook fitting portion 183 of the cabinet door lock 180 is restored to the normal position by the elastic force of the spring, which supports the hook fitting portion 183. The cabinet door 160, which is engaged with the cabinet door lock 180, is restored to the position spaced apart from the tub door 230 by the restoring force of the hook fitting portion 183, thereby completing the operation of closing the cabinet door 160 and the tub door 230.

Since the cabinet door 160 and the tub door 230 of the washing machine may be spaced apart from each other when they are closed, the direct transmission of vibrations of the tub to the cabinet is prevented during a washing operation.

As is apparent from the above description, the washing machine has an improved structure between the tub and the cabinet so as to prevent vibrations and noise of the tub from being transmitted to the cabinet, thereby reducing vibrations and noise generated from the cabinet. In some implementations, the washing machine offers an effect of preventing unpleasant vibrations and noise from being transmitted to a user.

In some implementations, the washing machine offers an effect of increasing the capacity of the tub by improving the structure between the tub and the cabinet.

What is claimed is:

1. A washing machine comprising:

a cabinet that defines a first introduction port;

a tub that is located in the cabinet and that defines a second introduction port that is concentrically positioned relative to the first introduction port;

a cabinet door that is connected to the cabinet, that is configured to open and close the first introduction port, and that includes a first hinge unit that includes a cabinet door rotating shaft; and a tub door that is connected to the tub, that is configured to open and close the second introduction port, and that includes a second hinge unit that includes at least one tub door rotating shaft that is spaced apart from the cabinet door rotating shaft of the cabinet door, wherein the second hinge unit comprises:

a stationary hinge link that is coupled to the tub; and a rotational hinge link that includes a first portion that is rotatably coupled to the stationary hinge link and that includes a second portion that is rotatably coupled to the tub door, and wherein the first portion of the rotational hinge link and the second portion of the rotational hinge link are configured to independently rotate, and wherein the tub door and the cabinet rotate about (i) a first rotational axis using the first portion of the rotational hinge link and (ii) a second, different rotational axis using the second portion of the rotational hinge link.

2. The washing machine according to claim 1, wherein the rotating shaft of the first hinge is angled toward a rear of the washing machine between 1.5 and 3.5 degrees.

3. The washing machine according to claim 1, wherein the first hinge unit is located at a first side of the first introduction port, and the second hinge unit is located at a first side of a front surface of the tub.

4. The washing machine according to claim 3, wherein the first hinge unit includes an upper rotating part and a lower rotating part that are spaced apart by a predetermined distance, and the second hinge unit is located between the upper rotating part and the lower rotating part and is configured to support the tub door.

5. The washing machine according to claim 1, wherein the second hinge unit includes an elastic rotating shaft that is located on the first portion of the rotational hinge link and that is configured to elastically bias the rotational hinge link in a direction that the tub door opens.

6. The washing machine according to claim 5, wherein:

the tub door is configured to open the second introduction port based on an elastic force of the elastic rotating shaft, and the cabinet door is configured to open the first introduction port based on being pressurized by rotation of the tub door.

7. The washing machine according to claim 1, wherein the stationary hinge link includes an upper link and a lower link that are spaced apart by a predetermined distance, and the rotational hinge link includes a first rotating part that is located between the upper link and the lower link and includes a second rotating part that is rotatably coupled to the tub door.

8. The washing machine according to claim 7, wherein a portion of the rotational hinge link between the first rotating part and the second rotating part is curved in a direction that the tub door opens.

9. The washing machine according to claim 1, wherein, based on the tub door rotating in a direction that the cabinet door closes the first introduction port and based on the tub door being pressurized by the cabinet door, the tub door is configured to close the second introduction port.

10. The washing machine according to claim 1, further comprising a cover member that is connected to the tub and that is configured to cover a front surface of the tub that is exposed between the first introduction port and the second introduction port.

11. The washing machine according to claim 10, wherein the cabinet includes a cabinet door lock that is configured to lock the cabinet door, and the tub includes a tub door lock that is configured to lock the tub door.

12. The washing machine according to claim 11, further comprising a lock-releasing device that is configured to unlock the tub door lock by unlocking the cabinet door lock based on the cabinet door being opened.

13. The washing machine according to claim 12, wherein the lock-releasing device comprises:

a release lever that is located at a handle of the cabinet door;

a release switch that is configured to detect an action of opening of the cabinet door in response to detecting an action of the release lever; and a tub door lock releaser that is configured to unlock the tub door lock in response to detecting an action of the release switch.

14. The washing machine according to claim 13, wherein the cover member includes a release button that is configured to release the tub door lock.

15. The washing machine according to claim 14, wherein the tub door lock releaser includes a tensile cable that is configured to unlock the tub door lock, and the release button is configured to apply tensile force to the tensile cable and is configured to unlock the tub door lock.

16. The washing machine according to claim 1, further comprising a plurality of weight balancers that are configured to dampen vibrations that are transmitted to the tub.

17. The washing machine according to claim 16, wherein the plurality of weight balancers are equally spaced around the second introduction port.

18. The washing machine according to claim 17, further comprising a cover member that is configured to conceal the plurality of weight balancers.

* * * * *